US010765932B1

(12) United States Patent
Tsai et al.

(10) Patent No.: US 10,765,932 B1
(45) Date of Patent: Sep. 8, 2020

(54) MAZE CAPABLE OF CHANGING ROLLING PATHS

(71) Applicants: Kuo-Ming Tsai, Coppell, TX (US); Peter Tsungyu Tsai, Coppell, TX (US)

(72) Inventors: Kuo-Ming Tsai, Coppell, TX (US); Peter Tsungyu Tsai, Coppell, TX (US)

( * ) Notice: Subject to any disclaimer, the term of this patent is extended or adjusted under 35 U.S.C. 154(b) by 0 days.

(21) Appl. No.: 16/591,401

(22) Filed: Oct. 2, 2019

(51) Int. Cl.
*A63F 7/04* (2006.01)

(52) U.S. Cl.
CPC ..... *A63F 7/042* (2013.01)

(58) Field of Classification Search
CPC ..... A63F 7/042; A63F 9/0826; A63F 9/08; A63F 9/0842
See application file for complete search history.

(56) References Cited

U.S. PATENT DOCUMENTS 3,696,549 A * 10/1972 Zilius ..... A63F 7/042 446/168
4,861,036 A * 8/1989 Watanabe ..... A63F 7/042 273/113
4,953,502 A * 9/1990 Hoover ..... A01K 15/025 119/416
4,953,863 A * 9/1990 Zeidler ..... A63F 7/0076 273/113
5,560,606 A * 10/1996 David ..... A63F 7/042 273/113
6,139,015 A * 10/2000 Hsieh ..... A63F 7/042 273/109
6,568,679 B1 * 5/2003 Sommer ..... A63F 7/042 273/118 R
7,165,768 B2 * 1/2007 Fang ..... A63F 7/042 273/153 S
7,338,045 B2 * 3/2008 Guha ..... A63F 7/042 273/109
7,600,756 B2 * 10/2009 Verdes ..... A63F 9/0842 273/153 S
2001/0033056 A1 * 10/2001 Francis ..... A63F 7/042 273/153 R (Continued)

FOREIGN PATENT DOCUMENTS

CN 102553224 A * 7/2012
FR 2646096 A1 * 10/1990 ..... A63F 7/042
WO WO-9219338 A1 * 11/1992 ..... A63F 7/042

(Continued)

*Primary Examiner* — Steven B Wong
(74) *Attorney, Agent, or Firm* — Chun-Ming Shih; Lanway IPR Services

(57) ABSTRACT

A maze capable of changing rolling paths contains: a rotatable three-dimensional block formed in a six-sided cube shape and defined by twenty-six square cube units for matching with a central fixing element. The rotatable three-dimensional block includes nine of the twenty-six square cube units formed in a 3 by 3 grid arranged on the rotatable three-dimensional block, and each square cube unit has three sets of rotary layers so as to form twelve rotary layer units. The rotatable three-dimensional block includes at least one path having at least one visible window formed on the at least one path respectively. The at least one path is formed in any one of a T shape, a cross shape, and an arc shape on each square cube unit, and the at least one path includes a ball rolling therein and at least one channel which communicates with one another.

6 Claims, 8 Drawing Sheets

(56) References Cited

U.S. PATENT DOCUMENTS

2009/0278309 A1* 11/2009 Miller ..... A63F 3/00094
273/153 R
2020/0054937 A1* 2/2020 Cao ..... A63F 7/30

FOREIGN PATENT DOCUMENTS

WO WO-9533537 A1 * 12/1995 ..... A63F 7/042
WO WO-2018230763 A1 * 12/2018 ..... A63F 9/08

* cited by examiner

MAZE CAPABLE OF CHANGING ROLLING PATHS

FIELD OF THE INVENTION

The present invention relates to a maze structure which is capable of changing rolling paths.

BACKGROUND OF THE INVENTION

A conventional maze structure is plane and contains multiple horizontal partitions and vertical partitions which define a path in which a ball rolls. However, it is easy for a user to walk out of the maze structure.

To enhance playing difficulty, a three-dimensional maze structure is formed in a pen shape and contains a plurality of partitions separated from one another. The three-dimensional maze structure also contains plural cutouts defined on the plurality of partitions respectively so as to form a path, hence a ball rolls downwardly in the path via the plural cutouts so as to get out of the three-dimensional maze structure. Nevertheless, it is also easy for a user to walk out of the three-dimensional maze structure.

The present invention has arisen to mitigate and/or obviate the afore-described disadvantages.

SUMMARY OF THE INVENTION

The primary objective of the present invention is to provide a maze in which the rotatable three-dimensional block is rotatable to guide the ball to roll and turn on the at least one path formed in any one of the T shape, the cross shape, and the arc shape on each square cube unit, wherein when the three rotary layer units of the rotatable three-dimensional block are rotated in different levels, the ball rolls in various paths so as to enhance interesting of the maze.

To obtain the above mentioned objective, a maze provided by a preferred embodiment of the present invention contains: a rotatable three-dimensional block formed in a six-sided cube shape and defined by twenty-six square cube units for matching with a central fixing element.

The rotatable three-dimensional block includes nine of the twenty-six square cube units formed in a 3 by 3 grid arranged on each of six surfaces of the rotatable three-dimensional block, and each of the twenty-six square cube units has three sets of rotary layers so as to form twelve rotary layer units.

The rotatable three-dimensional block includes at least one path formed on each square cube unit and having at least one visible window formed on the at least one path respectively. The at least one path is formed in any one of a T shape, a cross shape, and an arc shape on each square cube unit, and the at least one path includes a ball rolling therein and at least one channel which communicates with one another, such that the ball rolls from a path of one square cube unit to a path of another square cube unit. The at least one path is changeable by rotating each rotary layer unit so as to changeably roll the ball relative to each square cube unit and each of the at least one path.

DETAILED DESCRIPTION OF THE PREFERRED EMBODIMENTS

Figure 1:
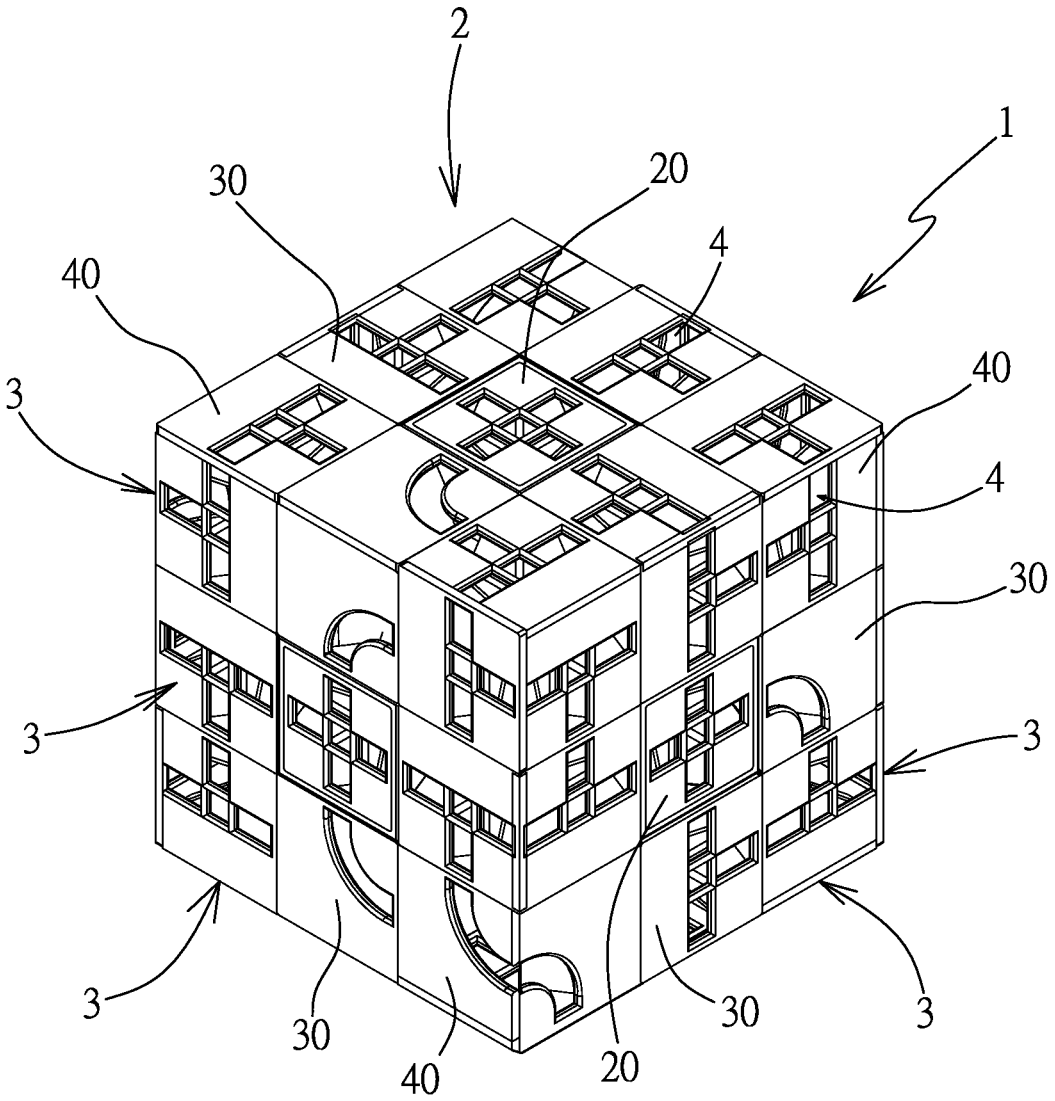
FIG. 1 is a perspective view showing the assembly of a maze according to a preferred embodiment of the present invention.
Figure 2:
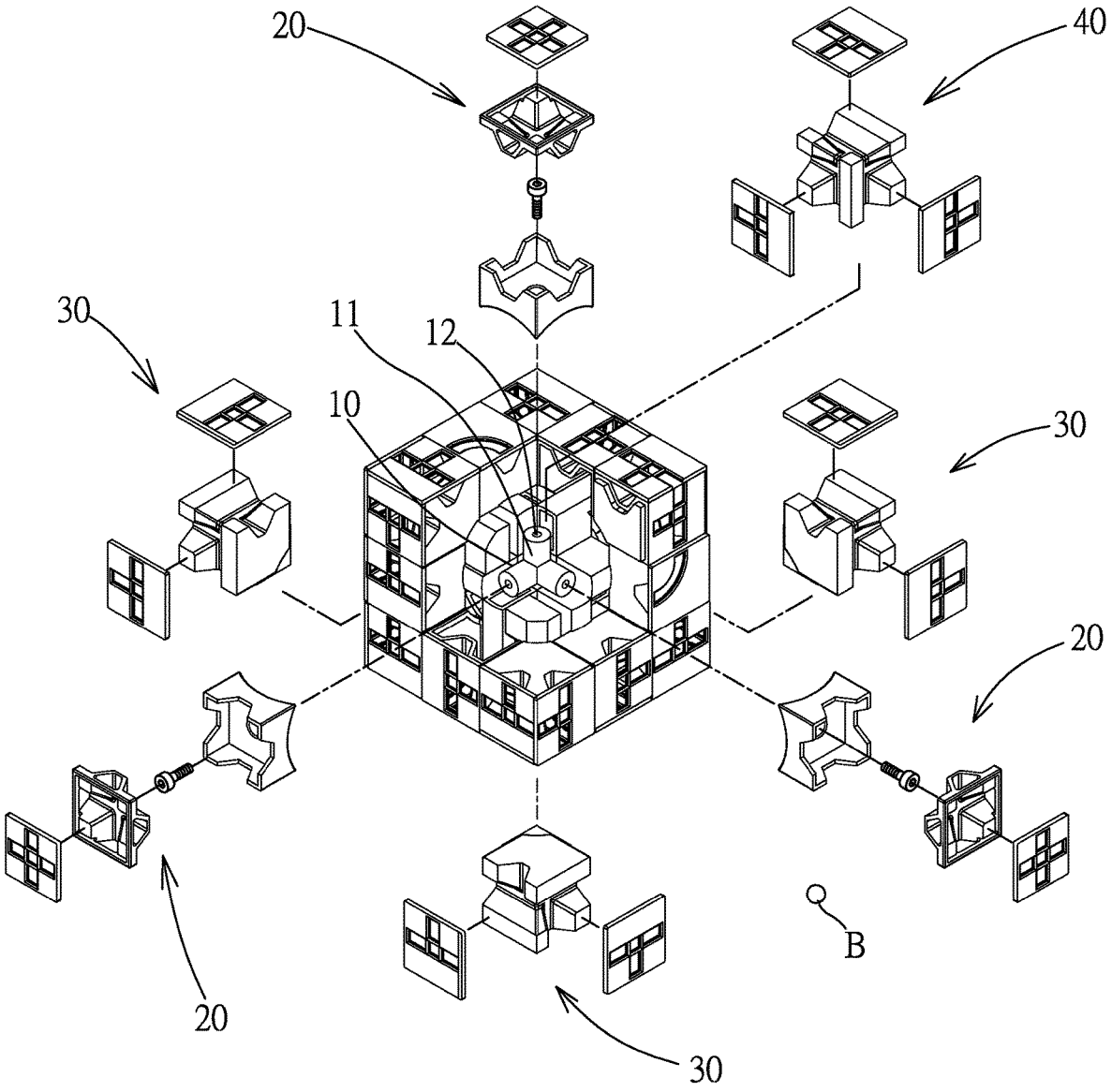
FIG. 2 is a perspective view showing the exploded components of the maze according to the preferred embodiment of the present invention.
Figure 3:
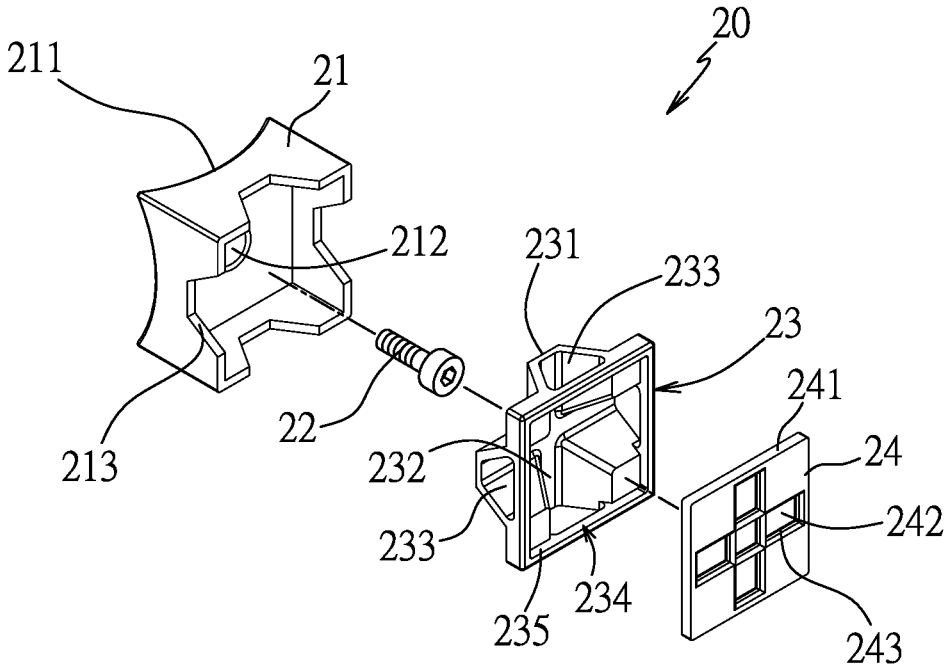
FIG. 3 is a perspective view showing the exploded components of a part of the maze according to the preferred embodiment of the present invention.
Figure 4:
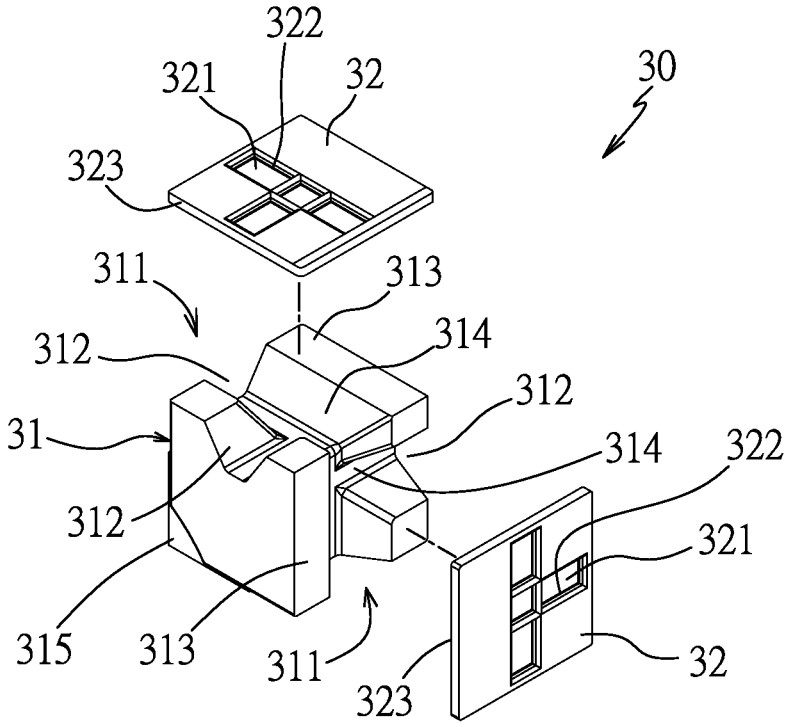
FIG. 4 is another perspective view showing the exploded components of a part of the maze according to the preferred embodiment of the present invention.
Figure 5:
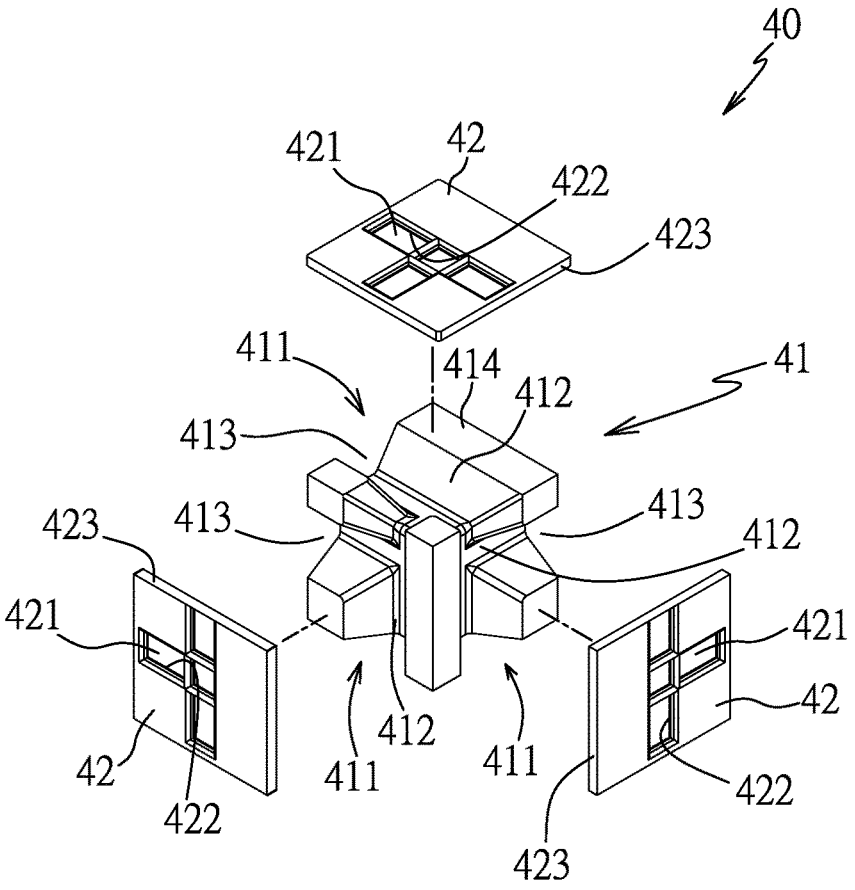
FIG. 5 is another perspective view showing the exploded components of a part of the maze according to the preferred embodiment of the present invention.
Figure 6:
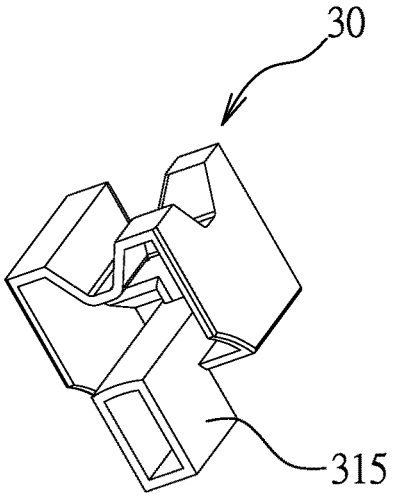
FIG. 6 is a perspective view showing the assembly of a part of the maze according to the preferred embodiment of the present invention.
Figure 7:
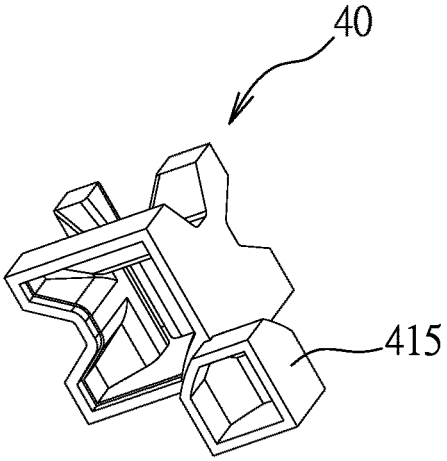
FIG. 7 is another perspective view showing the assembly of a part of the maze according to the preferred embodiment of the present invention.
Figure 8:
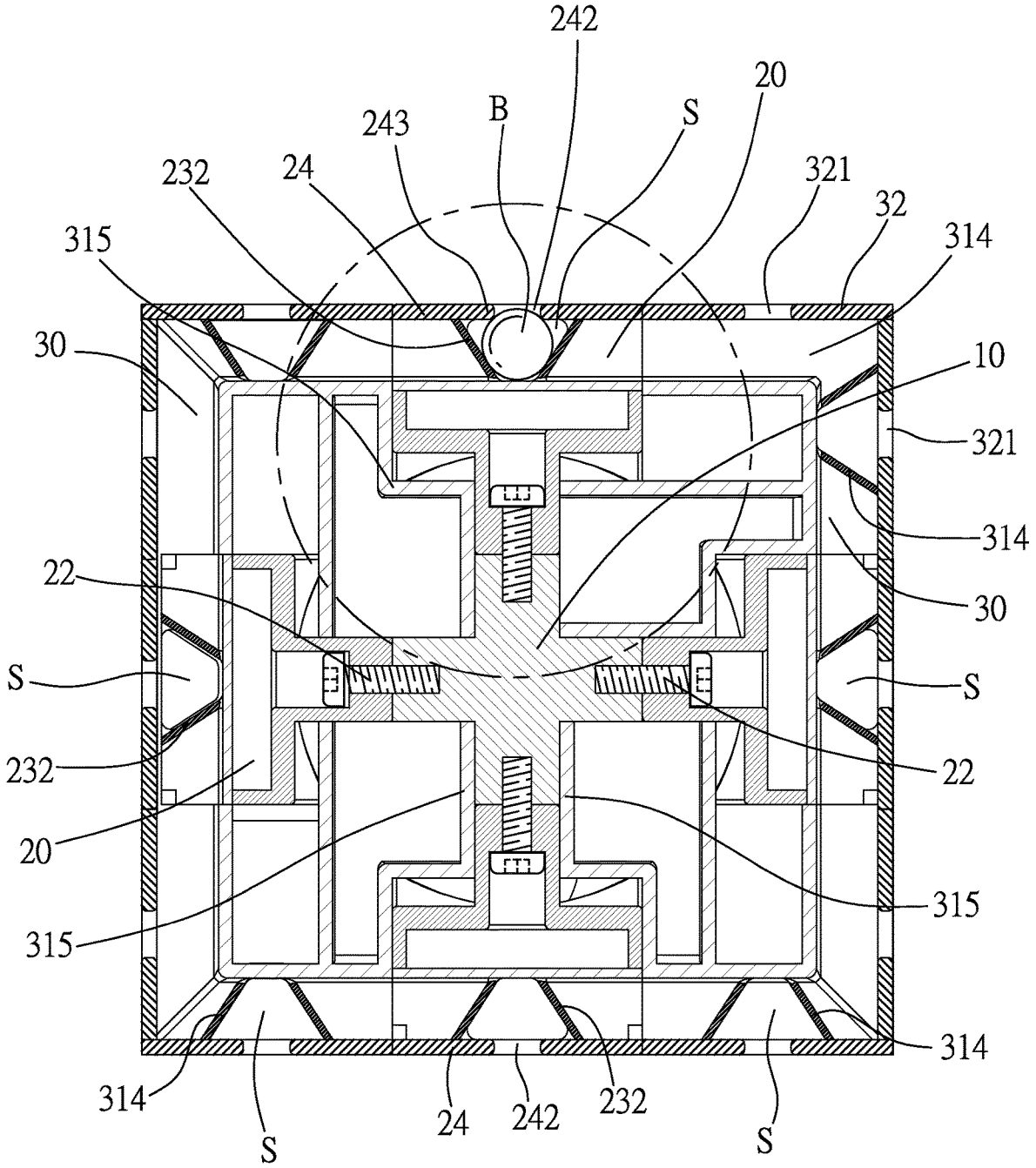
FIG. 8 is a cross sectional view showing the assembly of the maze according to the preferred embodiment of the present invention.
Figure 9:
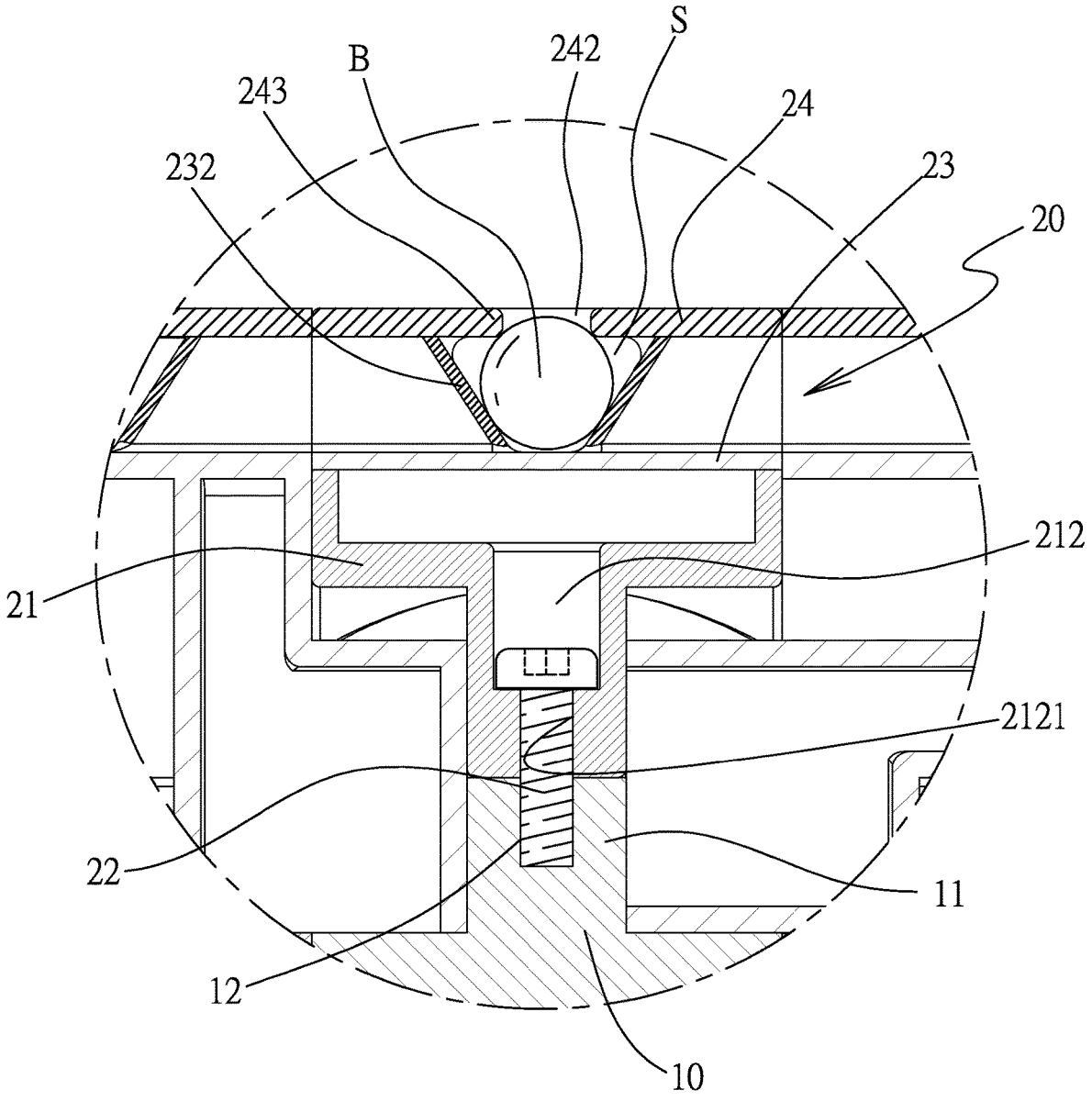
FIG. 9 is an amplified cross-sectional view of a portion of FIG. 8.
Figure 10:
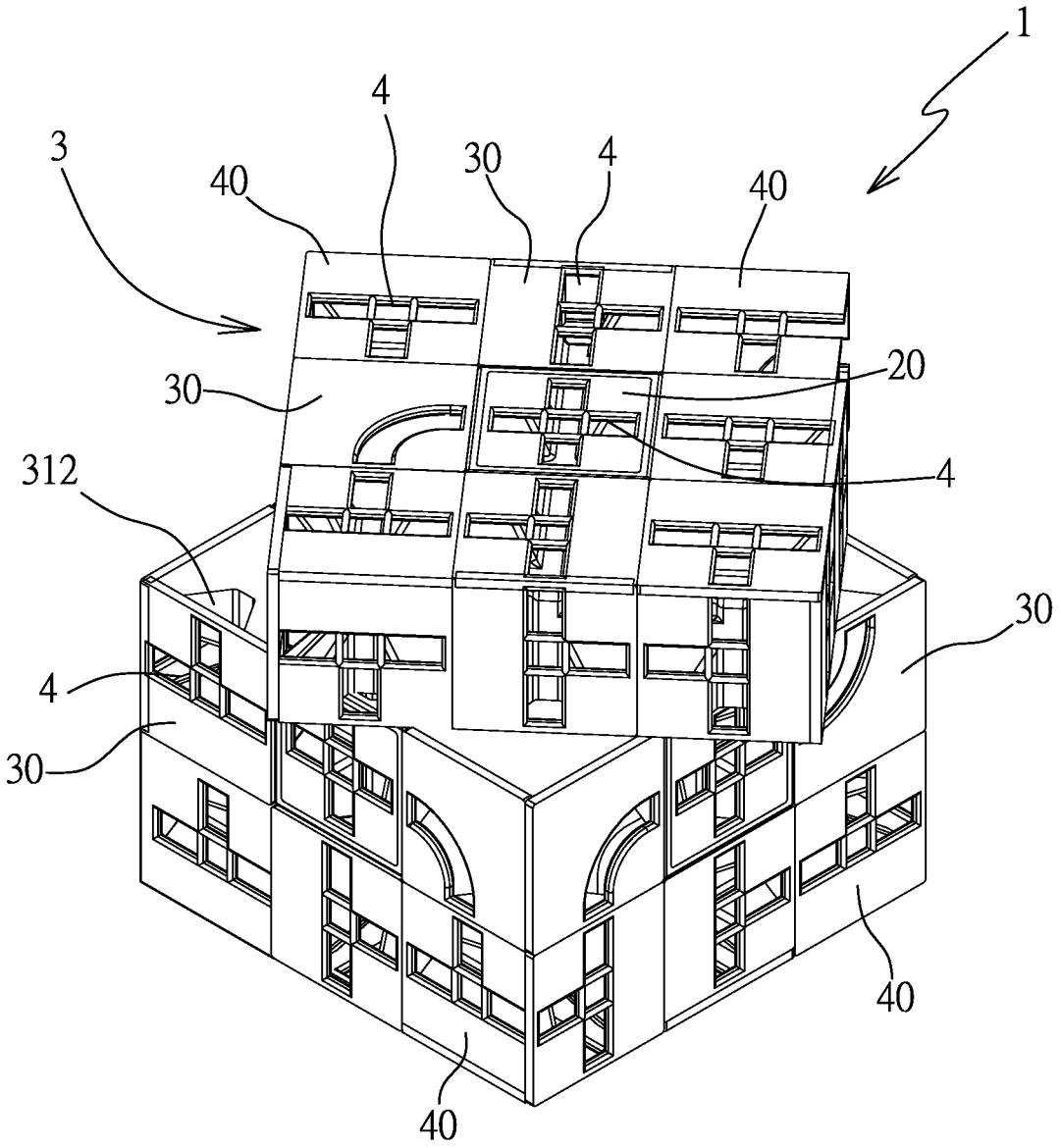
FIG. 10 is a perspective view showing the operation of the maze according to the preferred embodiment of the present invention.
Figure 11:
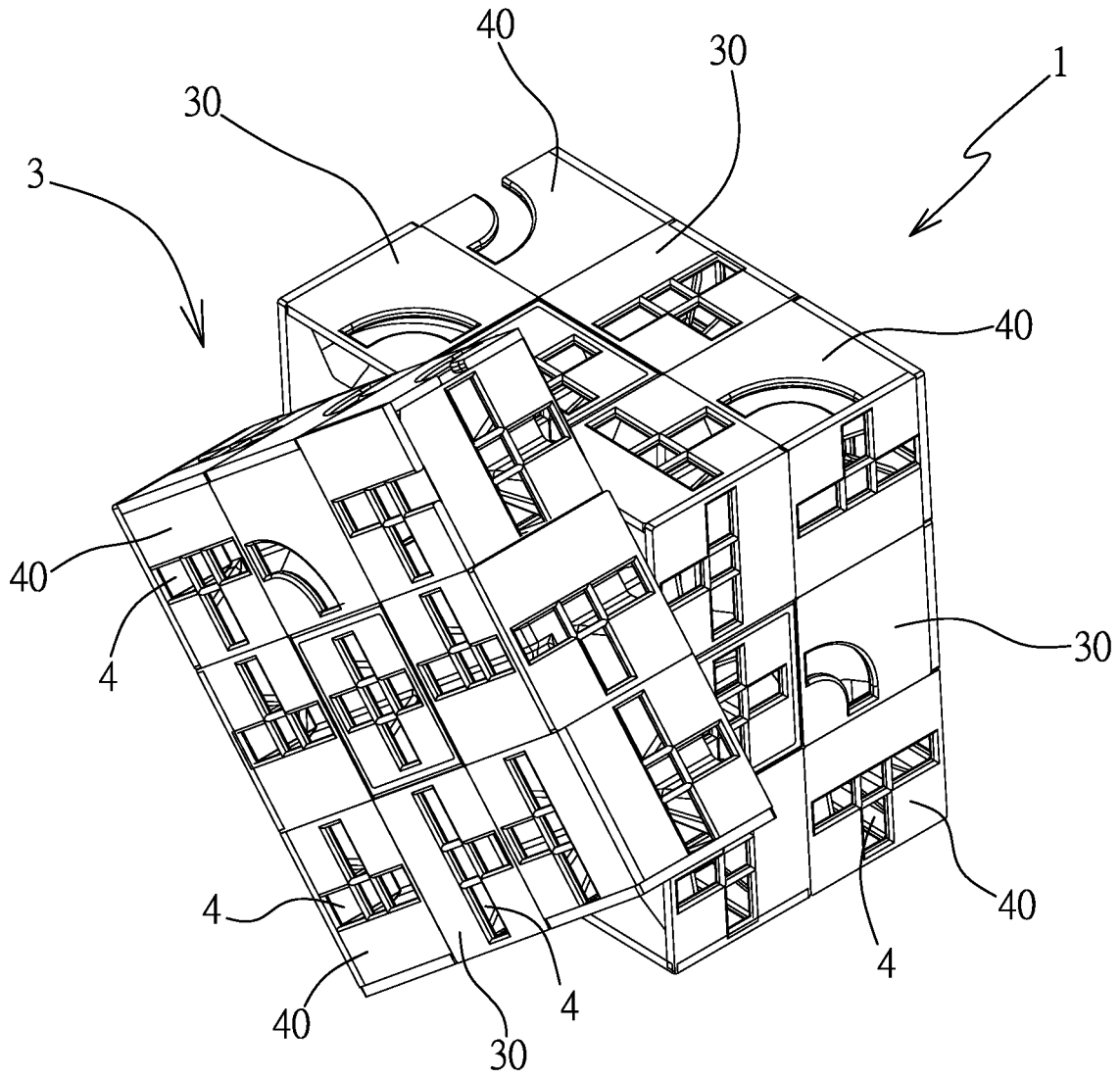
FIG. 11 is another perspective view showing the operation of the maze according to the preferred embodiment of the present invention.

With reference to FIGS. 1-11, a maze capable of changing rolling paths according to a preferred embodiment of the present invention comprises: a rotatable three-dimensional block 1 formed in a six-sided cube shape and defined by twenty-six square cube units for matching with a central fixing element 10, wherein the rotatable three-dimensional block 1 includes nine of the twenty-six square cube units formed in a 3 by 3 grid arranged on each of six surfaces of the rotatable three-dimensional block 1, and each of the twenty-six square cube units has three sets of rotary layers so as to form twelve rotary layer units 3, wherein each of the three rotary layer units 3 rotates along the central fixing element 10, thus changing a position of each square cube unit.

The rotatable three-dimensional block 1 includes at least one path 4 formed on each square cube unit and having at least one visible window formed on the at least one path 4 respectively, wherein the at least one path 4 is formed in any one of a T shape, a cross shape, and an arc shape on each square cube unit. The at least one path 4 includes a ball B rolling therein and at least one channel S which communicates with one another, such that the ball rolls from a path 4 of one square cube unit to a path 4 of another square cube unit, wherein the at least one path 4 is changeable by rotating each rotary layer unit 3 so as to changeably roll the ball B relative to each square cube unit and each of the at least one path 4.

The central fixing element 10 includes six three-dimensional extensions 11, wherein the six three-dimensional extensions 11 have six threaded orifices 12 defined on six central positions of six free end surfaces of the six three-dimensional extensions 11 respectively. The twenty-six square cube units include six first square cube units 20 rotatably connected with the six threaded orifices 12 of the central fixing element 10 individually, wherein the six first square cube units 20 have six first bodies 21, six first screwing elements 22, six first maze seats 23, and six first caps 24 respectively, wherein the six first bodies 21 have six first connection portions 212 corresponding to the six threaded orifices 12 of the central fixing element 10 individually, the six first connection portions 212 have six receiving orifices 2121 configured to accommodate the first screwing elements 22 respectively so that the first screwing elements 22 are screwed with the six threaded orifices 12 of the central fixing element 10 via the first screwing elements 22 individually, the six first bodies 21 have six arcuate faces 211 and six first uneven ridges 213 opposite to the six arcuate faces 211 respectively and connected with multiple first protrusions 231 of the six first maze seats 23 respectively. The six first maze seats 23 have six first open segments 234 opposite to the multiple first protrusions 231 respectively, and the six first open segments 234 have six first V-shaped tracks 232 and being a part of the at least one path 4 individually, the six first V-shaped tracks 232 have multiple first openings 233 defined below the multiple first protrusions 231 and communicate with the multiple first openings 233. The six first open segments 234 of the six first maze seats 23 have six first inner fringes 235 and connected with six first outer fringes 241 of the six first caps 24 respectively so as to close the six first open segments 234 individually, and the six first caps 24 have six first visible windows 242 corresponding to the six first V-shaped tracks 232 respectively so that the ball B is visible when being rolled on the at least one path 4. The six first visible windows 242 have six first limiting rims 243 individually, when the ball B rolls in the six first V-shaped tracks 232, the six first limiting rims 243 limit an upper portion of the ball B.

The twenty-six square cube units further include twelve second square cube units 30 arranged beside the six first square cube units 20 respectively, each of the twelve second square cube units 30 has a first rotatable member 315 relative to a first rotatable connection position of the central fixing element 10 and each of the six arcuate faces 211 of each six first square cube unit 20 so that the first rotatable member 315 is rotatably limited on the first rotatable connection position of the central fixing element 10 and each of the six arcuate faces 211 of each first square cube unit 20, wherein each second square cube unit 30 has a second body 31, and the second body 31 has two first maze units 311 perpendicular to each other, the two first maze units 311 have two second V-shaped tracks 314 respectively and being a part of the at least one path 4 individually, the two second V-shaped tracks 314 have two second openings 312 communicating with the multiple first openings 233 of each six first square cube unit 20. The two first maze units 311 have two first coupling portions 313 formed beside two tops of the two first maze units 311 respectively and coupled with two second caps 32 individually, wherein the two second caps 32 have two second coupling portions 323 corresponding to the two first coupling portions 313 of the second body 31 individually so that the two second coupling portions 323 of the two second caps 32 are connected with the two first coupling portions 313 of the second body 31 respectively. The two second caps 32 have two first visible windows 321 corresponding to the two second V-shaped tracks 314 of the two first maze units 311 individually so that the ball B is visible when being rolled on the at least one path 4. The two second visible windows 321 have two second limiting rims 322 individually, when the ball B rolls in the two second V-shaped tracks 314, the two second limiting rims 322 limit the upper portion of the ball B.

The twenty-six square cube units further include eight third square cube units 40 arranged on diagonal positions of the six first square cube units 20 respectively, each of the eight third square cube units 40 has a second rotatable member 415 relative to a second rotatable connection position of the central fixing element 10 and the first rotatable member 315 of each second square cube unit 30 so that the second rotatable member 415 is rotatably limited on the second rotatable connection position of the central fixing element 10 and each second square cube unit 30, wherein each third square cube unit 40 has a third body 41, and the third body 41 has three third maze seats 411 perpendicular to one another, the three third maze seats 411 have three third V-shaped tracks 412 respectively and being a part of the at least one path 4 individually, the three third V-shaped tracks 412 have three third openings 413 communicating with the multiple first openings 233 of each first square cube unit 20 and the two second openings 312 of each second square cube unit 30. The three third maze seats 411 have three second coupling portions 414 formed on three tops thereof respectively and coupled with three third caps 42 individually, wherein the three third caps 42 have three third coupling portions 423 corresponding to the three second coupling portions 414 of the second body 31 individually so that the three third coupling portions 423 of the three third caps 42 are connected with the three second coupling portions 414 of the third body 41 respectively. The three third caps 42 have three third visible windows 421 corresponding to the three third V-shaped tracks 412 of the three third maze seats 411 individually so that the ball B is visible when being rolled on the at least one path 4. The three third visible windows 421 have three third limiting rims 422 individually, when the ball B rolls in the three third V-shaped tracks 412, the three third limiting rims 422 limit the upper portion of the ball B.

Preferably, the six first uneven ridges 213 of the six first bodies 21 of the six first square cube units 20 are connected with the multiple first protrusions 231 of the six first maze seats 23 respectively in a gluing manner or in an ultrasonic welding manner, and the six first inner fringes 235 of the six first maze seats 23 are connected with the six first outer fringes 241 of the six first caps 24 respectively in the gluing manner or in the ultrasonic welding manner.

Preferably, the two first coupling portions 313 of the second body 31 of each second square cube unit 30 are connected with the two second coupling portions 323 of the two second caps 32 respectively in the gluing manner or in the ultrasonic welding manner.

Thereby, the rotatable three-dimensional block 1 is rotatable to guide the ball B to roll and turn on the at least one path 4 formed in any one of the T shape, the cross shape, and the arc shape on each square cube unit, wherein when the three rotary layer units 3 of the rotatable three-dimensional block 1 are rotated in different levels, the ball B rolls in various paths 4 so as to enhance interesting of the maze.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A maze capable of changing rolling paths comprising:

a rotatable three-dimensional block formed in a six-sided cube shape and defined by twenty-six square cube units for matching with a central fixing element, wherein the rotatable three-dimensional block includes nine of the twenty-six square cube units formed in a 3 by 3 grid arranged on each of six surfaces of the rotatable three-dimensional block, and each of the twenty-six square cube units has three sets of rotary layers so as to form twelve rotary layer units;

wherein the rotatable three-dimensional block includes at least one path formed on each square cube unit and having at least one visible window formed on the at least one path respectively, wherein the at least one path is formed in any one of a T shape, a cross shape, and an arc shape on each square cube unit, and the at least one path includes a ball rolling therein and at least one channel which communicates with one another, such that the ball rolls from a path of one square cube unit to a path of another square cube unit, wherein the at least one path is changeable by rotating each rotary layer unit so as to changeably roll the ball relative to each square cube unit and each of the at least one path;

wherein the central fixing element includes six three-dimensional extensions, wherein the six three-dimensional extensions have six threaded orifices defined on six central positions of six free end surfaces of the six three-dimensional extensions respectively; the twenty-six square cube units include six first square cube units rotatably connected with the six threaded orifices of the central fixing element individually, wherein the six first square cube units have six first bodies, six first screwing elements, six first maze seats, and six first caps respectively, wherein the six first bodies have six first connection portions corresponding to the six threaded orifices of the central fixing element individually, the six first connection portions have six receiving orifices configured to accommodate the first screwing elements respectively so that the first screwing elements are screwed with the six threaded orifices of the central fixing element via the first screwing elements individually, the six first bodies have six arcuate faces and six first uneven ridges opposite to the six arcuate faces respectively and connected with multiple first protrusions of the six first maze seats respectively; the six first maze seats have six first open segments opposite to the multiple first protrusions respectively, and the six first open segments have six first V-shaped tracks and being a part of the at least one path individually, the six first V-shaped tracks have multiple first openings defined below the multiple first protrusions and communicate with the multiple first openings; the six first open segments of the six first maze seats have six first inner fringes and connected with six first outer fringes of the six first caps respectively so as to close the six first open segments individually, and the six first caps have six first visible windows corresponding to the six first V-shaped tracks respectively, and the six first visible windows have six first limiting rims individually, when the ball rolls in the six first V-shaped tracks, the six first limiting rims limit an upper portion of the ball.

2. The maze as claimed in claim 1, wherein the twenty-six square cube units further include twelve second square cube units arranged beside the six first square cube units respectively, each of the twelve second square cube units has a first rotatable member relative to a first rotatable connection position of the central fixing element and each of the six arcuate faces of each six first square cube unit so that the first rotatable member is rotatably limited on the first rotatable connection position of the central fixing element and each of the six arcuate faces of each first square cube unit, wherein each second square cube unit has a second body, and the second body has two first maze units perpendicular to each other, the two first maze units have two second V-shaped tracks respectively and being a part of the at least one path individually, the two second V-shaped tracks have two second openings communicating with the multiple first openings of each six first square cube unit, the two first maze units have two first coupling portions formed beside two tops of the two first maze units respectively and coupled with two second caps individually, wherein the two second caps have two second coupling portions corresponding to the two first coupling portions of the second body individually so that the two second coupling portions of the two second caps are connected with the two first coupling portions of the second body respectively; the two second caps have two first visible windows corresponding to the two second V-shaped tracks of the two first maze units individually, and the two second visible windows have two second limiting rims individually, when the ball rolls in the two second V-shaped tracks, the two second limiting rims limit the upper portion of the ball.

3. The maze as claimed in claim 2, wherein the twenty-six square cube units further include eight third square cube units arranged on diagonal positions of the six first square cube units respectively, each of the eight third square cube units has a second rotatable member relative to a second rotatable connection position of the central fixing element and the first rotatable member of each second square cube unit so that the second rotatable member is rotatably limited on the second rotatable connection position of the central fixing element and each second square cube unit, wherein each third square cube unit has a third body, and the third body has three third maze seats perpendicular to one another, the three third maze seats have three third V-shaped tracks respectively and being a part of the at least one path individually, the three third V-shaped tracks have three third openings communicating with the multiple first openings of each first square cube unit and the two second openings of each second square cube unit; the three third maze seats have three second coupling portions formed on three tops thereof respectively and coupled with three third caps individually, wherein the three third caps have three third coupling portions corresponding to the three second coupling portions of the second body individually so that the three third coupling portions of the three third caps are connected with the three second coupling portions of the third body respectively; the three third caps have three third visible windows corresponding to the three third V-shaped tracks of the three third maze seats individually, and the three third visible windows have three third limiting rims individually, when the ball rolls in the three third V-shaped tracks, the three third limiting rims limit the upper portion of the ball.

4. The maze as claimed in claim 1, wherein the six first uneven ridges of the six first bodies of the six first square cube units are connected with the multiple first protrusions of the six first maze seats respectively in a gluing manner or in an ultrasonic welding manner, and the six first inner fringes of the six first maze seats are connected with the six first outer fringes of the six first caps respectively in the gluing manner or in the ultrasonic welding manner.

5. The maze as claimed in claim 2, wherein the two first coupling portions of the second body of each second square cube unit are connected with the two second coupling portions of the two second caps respectively in the gluing manner or in the ultrasonic welding manner.

6. The maze as claimed in claim 3, wherein the two first coupling portions of the second body of each second square cube unit are connected with the two second coupling portions of the two second caps respectively in the gluing manner or in the ultrasonic welding manner.

* * * * *